US009182701B2

(12) United States Patent
Gotoh et al.

(10) Patent No.: US 9,182,701 B2
(45) Date of Patent: Nov. 10, 2015

(54) IMAGE FORMING APPARATUS AND IMAGE DENSITY CONTROL

(71) Applicants: Keita Gotoh, Kanagawa (JP); Akira Yoshida, Tokyo (JP)

(72) Inventors: Keita Gotoh, Kanagawa (JP); Akira Yoshida, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/517,286

(22) Filed: Oct. 17, 2014

(65) Prior Publication Data

US 2015/0125168 A1 May 7, 2015

(30) Foreign Application Priority Data

Nov. 6, 2013 (JP) ..... 2013-230541

(51) Int. Cl.
*G03G 15/00* (2006.01)
*G03G 15/02* (2006.01)
*G03G 15/043* (2006.01)

(52) U.S. Cl.
CPC ..... *G03G 15/0266* (2013.01); *G03G 15/043* (2013.01); *G03G 15/5033* (2013.01); *G03G 15/5041* (2013.01); *G03G 15/5058* (2013.01)

(58) Field of Classification Search
CPC ..... G03G 15/0827; G03G 15/5041; G03G 15/0855; G03G 15/5045; G03G 15/5033
See application file for complete search history.

(56) References Cited

U.S. PATENT DOCUMENTS 5,307,118 A * 4/1994 Morita ..... 399/42
7,277,659 B2 * 10/2007 Kobayashi et al. ..... 399/106
2007/0116483 A1 5/2007 Kobayashi et al.
2008/0205923 A1 8/2008 Takeuchi et al.
2009/0202263 A1 8/2009 Yoshida et al.
2009/0324267 A1 12/2009 Yoshida et al.
2011/0052239 A1 3/2011 Tanaka et al.

FOREIGN PATENT DOCUMENTS

JP 2000-147848 5/2000
JP 2001-312126 11/2001
JP 2005-308833 11/2005
JP 2007-140185 6/2007
JP 2009-186847 8/2009
JP 2010-019969 1/2010
JP 2010-039071 2/2010
JP 2010-145538 7/2010
JP 2010-266682 11/2010
JP 2011-047994 3/2011
JP 2011-048185 3/2011
JP 2011-059178 3/2011

(Continued)

*Primary Examiner* — Rodney Bonnette
(74) *Attorney, Agent, or Firm* — Oblon, McClelland, Maier & Neustadt, L.L.P.

(57) ABSTRACT

An image forming apparatus includes an image bearer; a charger to charge the image bearer; an electrostatic latent image former to form an electrostatic latent image on the image bearer; an image developer to develop the electrostatic latent image with a toner to form a visual toner image; a transferer to transfer the toner image on a transfer material; a toner concentration calculator to calculate a concentration of the toner; and an optical detector. At least a toner patch image is formed on the image bearer with an irradiation quantity set such that an irradiated part potential is larger than a developing condition, the toner patch image is read by the optical detector, and the charging condition is corrected on the basis of a difference between a toner concentration of the toner patch image and a target toner concentration.

10 Claims, 21 Drawing Sheets

(56) References Cited

FOREIGN PATENT DOCUMENTS

| | | |
|---|---|---|
| JP | 2011-170025 | 9/2011 |
| JP | 2011-191510 | 9/2011 |
| JP | 2012-220735 | 11/2012 |
| JP | 2013-122549 | 6/2013 |
| JP | 2013-195767 | 9/2013 |
| JP | 2014-006471 | 1/2014 |

* cited by examiner

NORMAL IMAGE

BLURRED EDGE IMAGE

VARIATION

DOT SHAPE

IMAGE FORMING APPARATUS AND IMAGE DENSITY CONTROL

CROSS-REFERENCE TO RELATED APPLICATIONS

This patent application is based on and claims priority pursuant to 35 U.S.C. §119 to Japanese Patent Application No. 2013-230541, filed on Nov. 6, 2013, in the Japan Patent Office, the entire disclosure of which is hereby incorporated by reference herein.

BACKGROUND

1. Technical Field

The present invention relates to an image forming apparatus such as copiers, facsimiles and scanners.

2. Description of the Related Art

In electrophotographic image forming apparatuses, an image control method detecting toner adherence quantity with an optical sensor is widely used as an image density guarantee of produced images. This method includes changing image forming conditions (development potential or LD writing density) to form plural reference patches on a photoreceptor or an intermediate transfer belt, and irradiating infrared LED light to the reference patches. The method further includes detecting reflection light (regular or irregular reflection light) with an optical sensor such as photodiodes and phototransistors, and converting the detection results to toner adherence quantities of the individual tone patches. Then, the toner adherence quantity relative to the potential is plotted to do linear approximation. This slope of the line is development γ. An image density control controlling image forming conditions (development potential) to obtain a targeted adherence quantity using the approximation straight line is known.

Japanese published unexamined application No. JP-2005-308833-A discloses a method of detecting a halftone patch with an optical toner concentration sensor and a patch image area with an imaging apparatus to form an image without background fouling and blurred edge. Japanese published unexamined application No. JP-2000-147848-A discloses a method of correcting a charge bias based on information detected by a temperature and humidity sensor to optimally keep a background potential.

However, when a charging bias is determined so as to have a predetermined background potential after developing bias is determined so as to have a potential calculated as above, a correlation between the charging bias applied at a charging position and a charging potential remaining at a developing position changes when a surface potential of a photoreceptor varies due to time or an influence of environment. Therefore, when the charging bias is not properly set, the narrow background potential causes background fouling, and the wider background potential causes a blurred edge. A method of lowering the charging bias to the developing bias to form and detect a background fouling pattern and forecasting the background potential from the background fouling quantity is disclosed. However, the method forms background fouling on the whole surface of a photoreceptor in the main scanning direction, resulting in increase of toner consumption.

The method disclosed in Japanese published unexamined application No. JP-2005-308833-A forms plural patch patterns, and therefore insufficiently controls a toner field, does not disclose a method of precisely controlling the background potential with only a P sensor, and the imaging apparatus is expensive. The method disclosed in Japanese published unexamined application No. JP-2000-147848-A is difficult to grasp the surface potential properties of the photoreceptor with only an environment sensor, and the background potential is not properly maintained depending on the usage environment.

SUMMARY

Accordingly, one object of the present invention is to provide an image forming apparatus producing no abnormal images having background fouling and blurred edges while controlling toner consumption by forming a background fouling pattern for properly maintaining a background potential on not all the surface of a photoreceptor when controlling image quality.

These objects and other objects of the present invention, either individually or collectively, have been satisfied by the discovery of an image forming apparatus including an image bearer; a charger to charge the image bearer; an electrostatic latent image former to form an electrostatic latent image on the image bearer; an image developer to develop the electrostatic latent image with a toner to form a visual toner image; a transferer to transfer the toner image on a transfer material; a toner concentration calculator to calculate a concentration of the toner; and an optical detector, wherein a least a toner patch image is formed on the image bearer with an irradiation quantity set such that an irradiated part potential is larger than that of the developing conditions, the toner patch image read by the optical detector, and the charging condition is corrected on the basis of a difference between a toner concentration of the toner patch image and a targeted toner concentration.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION

Figure 1:
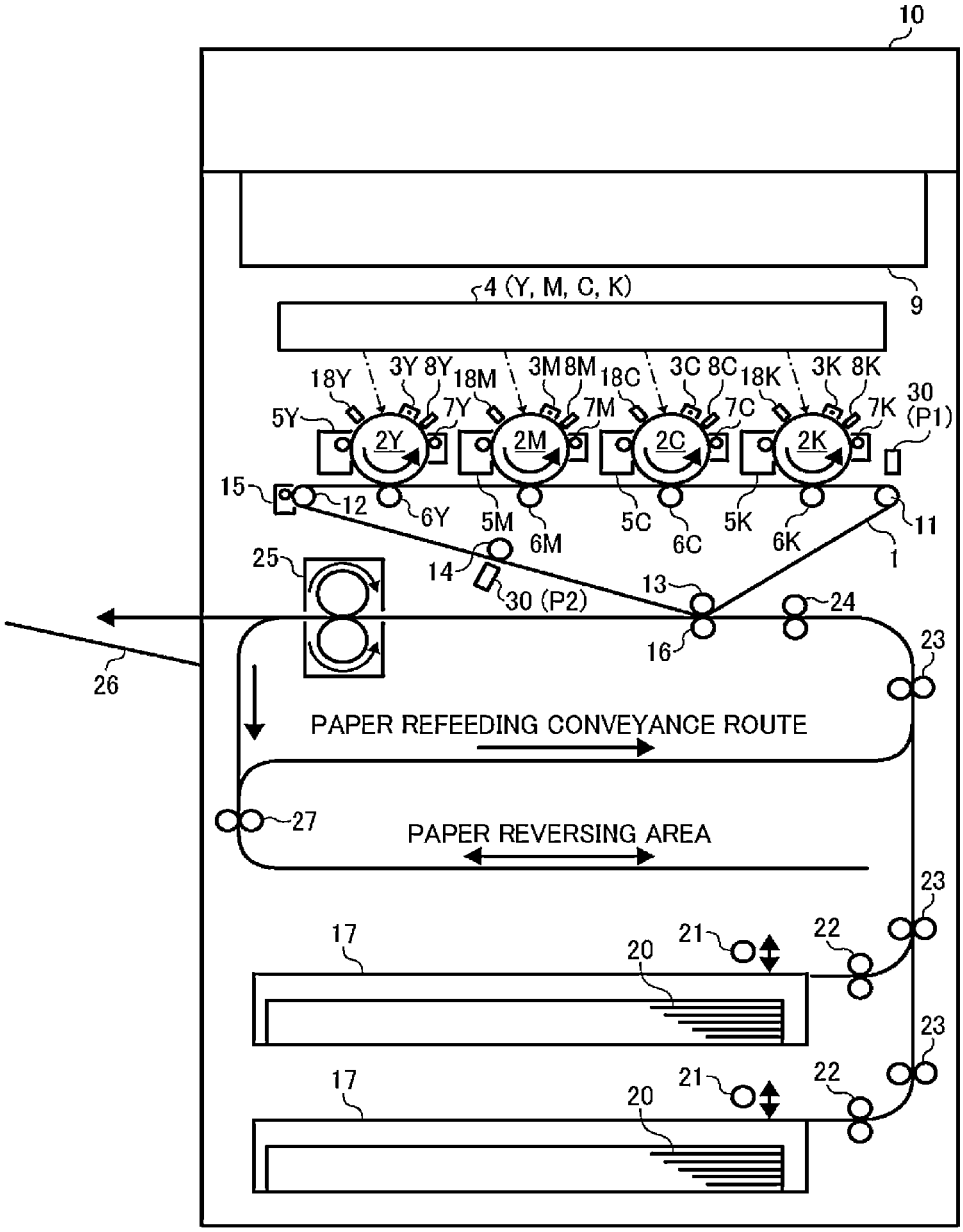
FIG. 1 is a schematic front view of an embodiment of the image forming apparatus of the present invention.

The present invention provides an image forming apparatus effectively preventing background fouling when the background potential is small and blurred edge when the background potential is large to produce quality images because of properly maintaining a background potential.

Exemplary embodiments of the present invention are described in detail below with reference to accompanying drawings. In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

FIG. 1 is a schematic front view illustrating an embodiment of the image forming apparatus of the present invention. In FIG. 1, photoreceptor drums 2Y (yellow), 2M (magenta), 2C (cyan) and 2k (Black) are parallely located along an extended surface of an intermediate transfer belt 1 which is an image bearer and an intermediate transferer. Around the photoreceptor drum 2, a charger 3 which is a charging means, a writing unit 4 which is a latent image forming means, a developing unit 5 which is a developing means, a first transfer roller 6 which is a first transferer and a photoreceptor cleaning unit 7 are located in the order of its rotational direction. A quenching lamp 8 is located above the photoreceptor cleaning unit 7, and a scanner 9 and an ADF 10 are located above the writing unit 4.

The intermediate transfer belt 1 is runnably supported by plural rollers 11, 12 and 13. An intermediate transfer belt cleaning unit 15 is located at a position opposite to the roller 12. A second transfer roller 16 is located at a position opposite to the roller 13.

Plural paper feed trays 17 each containing recording papers 20 are located at the lower part of the apparatus. The recording paper 20 is fed by a pickup roller 21 and a paper feed roller 22, conveyed by a conveyance roller 23 and sent by a pair of registration rollers 24 to a second transferer in a predetermined timing. A fixing unit 25 is located on the downstream side in a paper conveyance direction of the second transferer. The number 26 is a paper discharge tray and 27 is a pair of switchback rollers in FIG. 1.

The image forming operation in the apparatus is explained.

When a print start order is entered, rollers on and around the photoreceptor drum 2, the intermediate transfer belt 1 and the paper feed conveyance route start rotating in a predetermined timing to start feeding the recording paper 20 from the paper feed tray 17. Meanwhile, the surface of the photoreceptor drum 2 is charged by the charger 3 to have a uniform potential and irradiated with writing light from the writing unit 4 according to image data. The photoreceptor drum 2 bearing an electrostatic latent image which is a potential pattern after irradiated on its surface is provided with a toner from the developing unit 5 to develop the electrostatic latent image to have a specific color. There are four photoreceptor drums 2 in FIG. 1, and toner images of yellow, magenta cyan and black (color orders depend on systems) are developed on the respective photoreceptor drums 2.

The toner image developed on each of the photoreceptor drums 2 is first transferred onto the intermediate transfer belt 1 with a first transfer bias applied to the first transfer roller 6 and a pressure force at a contact point with the intermediate transfer belt 1. The first transfer operation is repeated for 4 times while matching the timing to form a full-color toner image on the intermediate transfer belt 1. The full-color toner image is second transferred on the recoding paper 20 conveyed by the pair of registration rollers 24 in a predetermined timing. Then, the second transfer is made by a second transfer bias applied to the second transfer roller 16 and a pressure force. The recording paper 20 the full-color toner image is transferred on passes the fixing unit 25 to fix the toner image thereon with heat.

The recording paper is conveyed straight to the paper discharge tray 26 in single-sided printing, and conveyed downward to a paper reversing area in double-sided printing. A conveyance direction of the recording paper 20 having reached the paper reversing area is reversed, and the recording paper goes out of the paper reversing area from its rear end side. This is called switchback operation turning the recording paper 20 upside down. The overturned recording paper 20 does not return to the fixing unit 25 and meets the original paper feed route through a paper refeeding conveyance route. Then, a toner image is transferred thereon as it is in the single-sided printing and discharged through the fixing unit 25. This is the double-sided printing.

The photoreceptor drum 2 having passed the first transferer bears a first transfer residual toner on its surface, and which is removed by the photoreceptor cleaning unit 7 formed of a blade and a brush. Then, the surface of the photoreceptor drum 2 is uniformly discharged by the quenching lamp 8 and ready to be charged for the next image formation.

The intermediate transfer belt 1 having passed the second transferer bears a second transfer residual toner on its surface, and which is removed by the intermediate transfer belt cleaning unit 15 formed of a blade and a brush. Then, the intermediate transfer belt 1 is ready for the next transfer of a toner image. These operations are repeated to make the single-sided or double-sided print.

The image forming apparatus in FIG. 1 includes a toner image detection sensor (optical sensor unit) 30 formed of an optical sensor as a concentration detector detecting the concentration of a toner image formed on the outer circumferential surface of the intermediate transfer belt 1. The toner image detection sensor 30 detects the concentration of a toner image which is an image pattern formed on the intermediate transfer belt 1 for correcting irregular image density. In FIG. 1, the toner image detection sensor 30 is located at a position P1 opposite to the roller 11 (before the second transfer) across the intermediate transfer belt 1. When the toner image detection sensor 30 is located on the downstream side of the second transferer, a roller 14 is located to prevent the intermediate transfer belt 1 from waving inside, and the sensor is located at a position P2 opposite thereto. In the image forming apparatus, a toner pattern image for control is formed on the photoreceptor drum 2 and conveyed to the transfer position to the intermediate transfer belt 1 on the downstream side.

Figure 2:
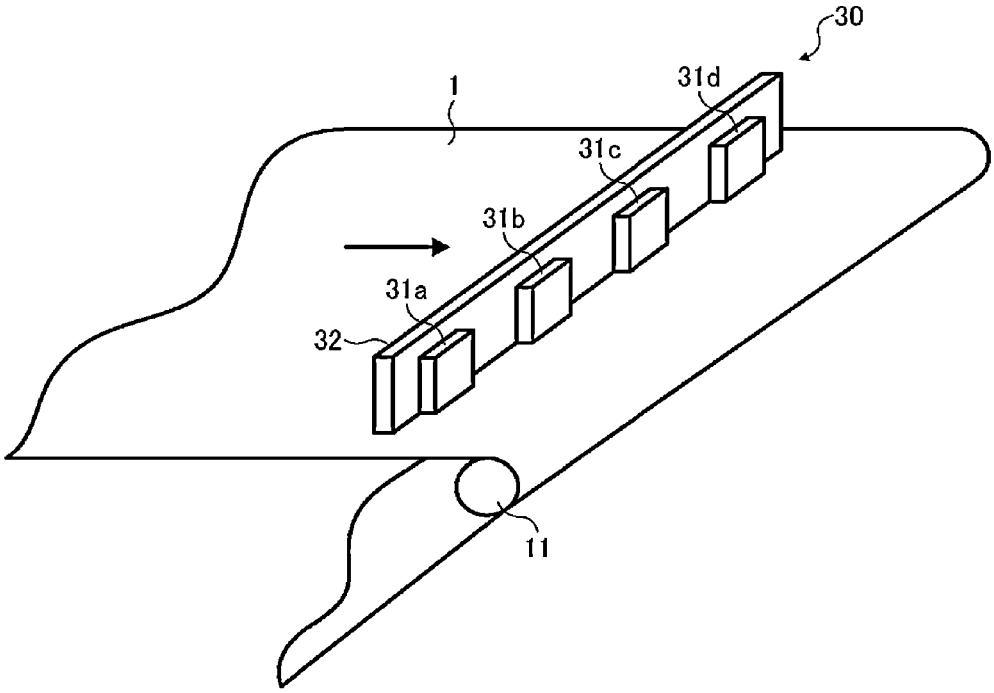
FIG. 2 is a schematic view illustrating a toner concentration detection sensor used in an embodiment of the present invention.

FIG. 2 illustrates the toner image detection sensor 30 located at the position P1. The toner image detection sensor 30 includes 4 sensor heads 31*a*, 31*b*, 31*c*, and 31*d* on a sensor substrate 32. Namely, 4 sensor heads 31 are located in a main scanning direction (axial direction of the photoreceptor drum 2) perpendicular to the conveyance direction of the recording paper 20) to measure toner adherence amounts at 4 places at the same time. The number of the sensor head of the toner image detection sensor 30 is not limited to 4, and may be 1 or 2, or 4 to 7 for each color.

Figure 3:
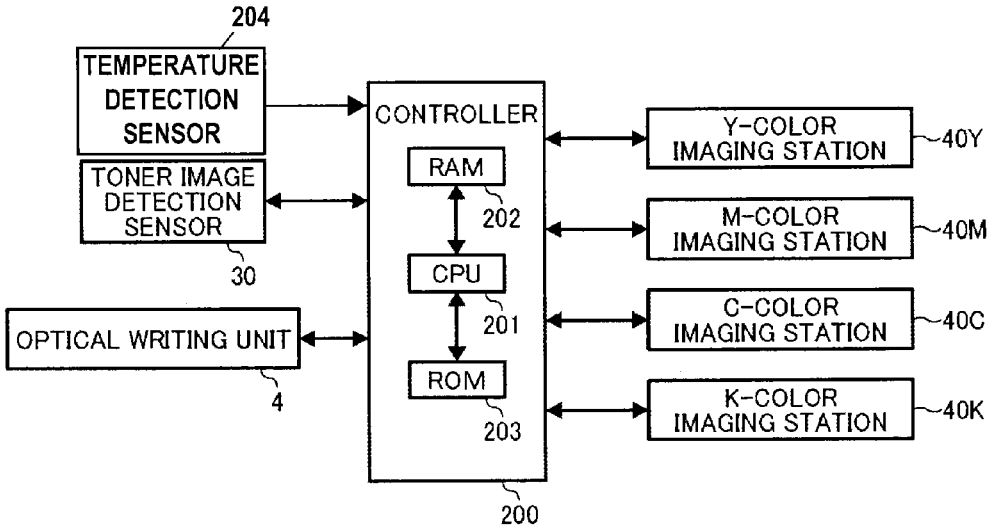
FIG. 3 is a block diagram of a controller used in an embodiment of the present invention.

FIG. 3 is a block diagram of a controller used in an embodiment of the present invention. A controller 200 includes a processor CPU 201 formed of a microcomputer, and nonvolatile memories RAM 202 and ROM 203. Imaging stations 40Y, 40M, 40C and 40K for each color, the writing unit 4, and the toner image detection sensor 30 are electrically connected with the controller 200, and which controls various devices based on control programs memorized in RAM 202. Output conversion data (conversion table) and output conversion formula (algorism) mentioned later, as output conversion information used to calculate a toner concentration (adherence amount) from a detection value of the toner image detection sensor 30, are memorized in the RAM 202. The controller 200 works as a toner concentration calculator as well. Moreover, the controller 200 serves as a counter to count a number of prints. Additionally, a temperature detection sensor 204 detects the environmental temperature.

Figure 4:
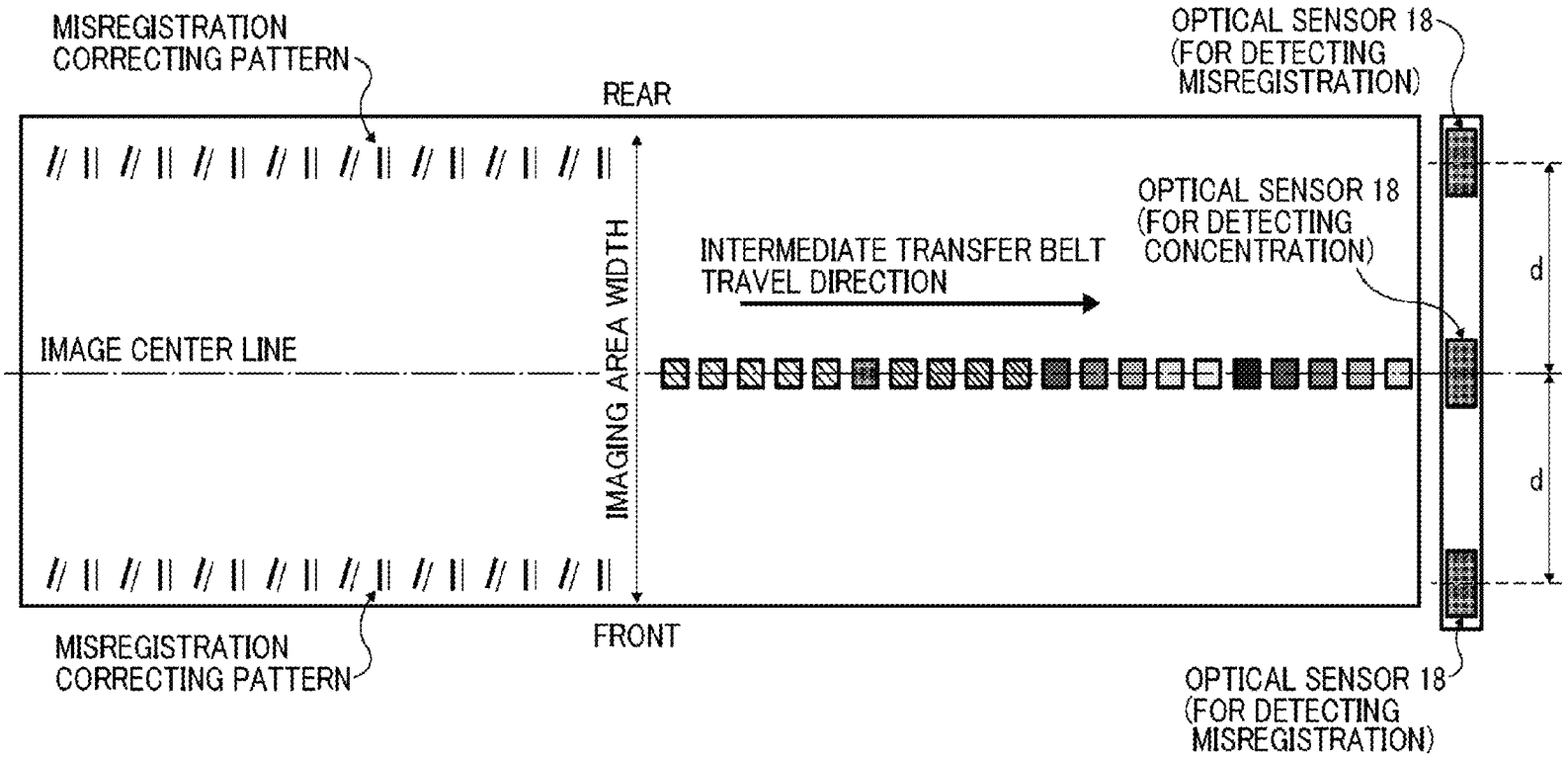
FIG. 4 is a schematic view explaining an image density adjustment pattern.

Next, the image density adjustment pattern and the detection configuration are explained. In this embodiment, an image density adjustment pattern is formed in series and a detection sensor has one head. As FIG. 4 shows, this embodiment locates the image density adjustment pattern at the center of an image area width. This is because the center is influenced least by density deviation in the imaging width in the main scanning direction. The image density adjustment pattern has 5 tones, and is an analogue pattern formed by fixing the LD power and sequentially changing the charging bias and the developing bias to change the developing potential. The image density adjustment pattern has 5 tones in this embodiment, but the number of the tones is preferably selected according to stability of the imaging system.

The main purpose of the image density adjustment is to guarantee image density of produced images. The image density adjusting method of detecting the toner adherence amount with an optical sensor and adjusting imaging conditions such that the toner adheres in a desired amount to maintain a specific image density of produced images is widely used. This method is explained in brief.

The imaging conditions (the developing potential or the writing density of the LD) are changed to from plural standard toner patches on the photoreceptor or the intermediate transfer belt. LED light is irradiated to the toner patch, and reflection light (regular reflection light or diffusion reflection light) therefrom is detected an optical sensor such as photodiodes and phototransistors. The detected results is converted into a toner adherence amount to obtain the adherence amount of each toner patch. Then, the toner adherence amount of the toner patch is plotted relative to the developing potential to calculate the developing γ which is an inclination of the approximation straight line and a development threshold voltage Vk which is an x-intercept. From the primary straight line of each color, the developing potential capable of obtaining a target adherence amount. Form the developing potential, the developing bias and the charging bias are determined, and the imaging condition is readjusted to obtain proper image density.

In the electrophotographic image forming method, variation of the charging potential of a photoreceptor accompanied with deterioration of the surface thereof due to environmental variation and increase of production volume causes variation of background potential. Specific examples of abnormal images due to the variation of the background potential include background fouling which is toner adherence to non-image area when lowered and blurred edge in halftone when raised. Therefore, the background potential needs to properly be set. Currently, the background potential is changed to a predetermined value according to the environmental variation such as temperature and humidity. However, this does not detect whether abnormal images are actually produced, and image quality may not be improved.

Figure 5:
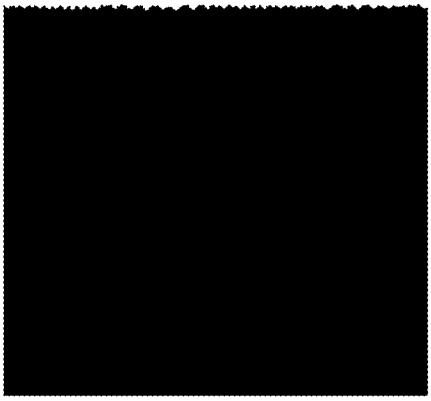
FIG. 5 is a schematic view showing comparison between a normal image and an image having a blurred edge.
Figure 5:
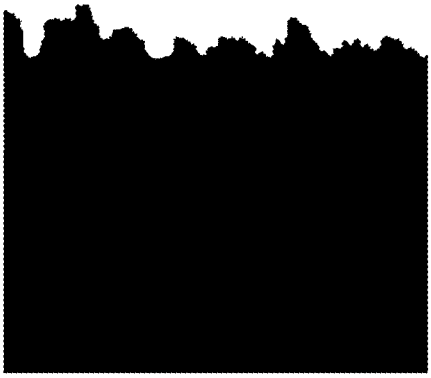
Figure 6:
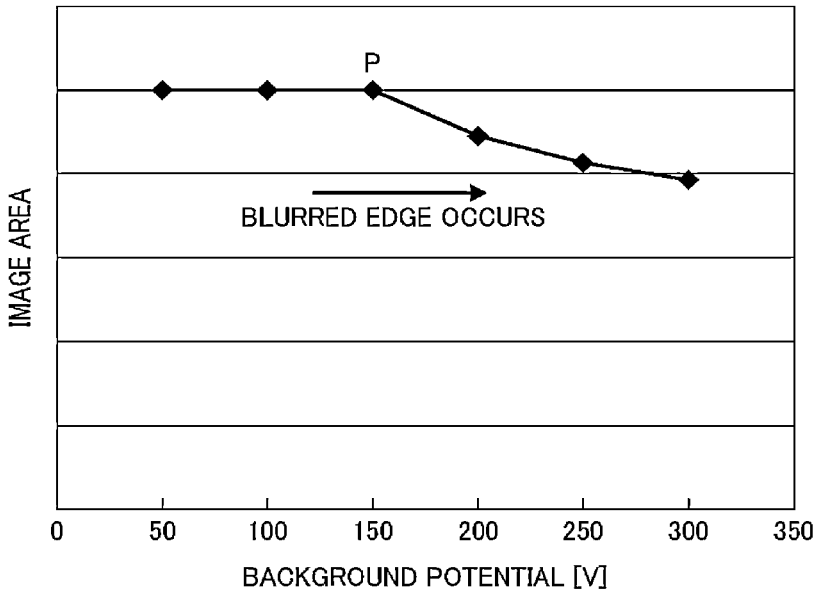
FIG. 6 is a diagram showing a relation between a background potential and an image area.
Figure 7:
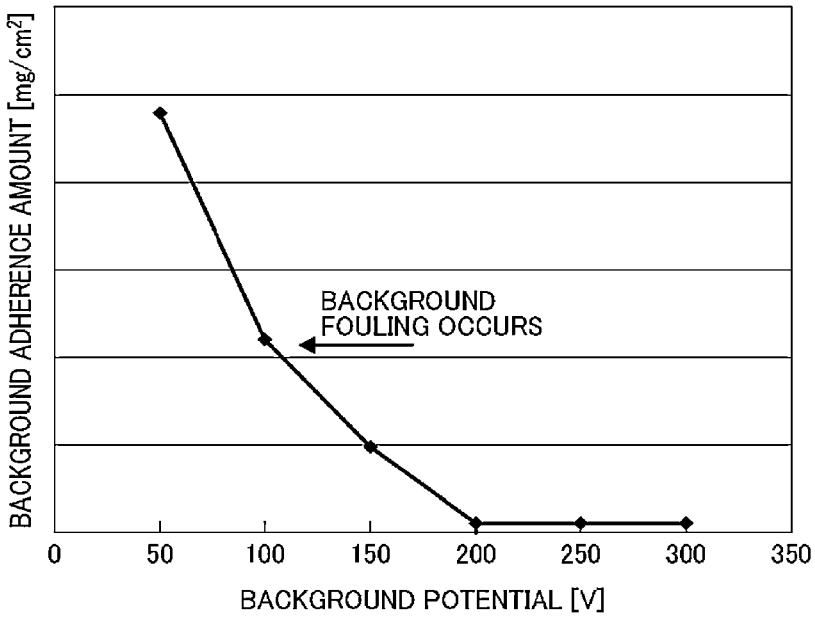
FIG. 7 is a diagram showing a relation between a background potential and a background toner adherence amount.

FIG. 5 is a schematic view showing comparison between a normal image and an image having a blurred edge. FIG. 6 is a diagram showing a relation between a background potential and an image area. In FIG. 6, when the background potential rises from point P, blurred edge decreases image area. The toner image detection sensor 30 is located at P1 and the toner adherence amount is measured thereby to detect background fouling. FIG. 7 is a diagram showing a relation between a background potential and output of the image density sensor. FIG. 7 proves the background potential not greater than 200 V causes background fouling and increase toner adherence amount.

Figure 8A:
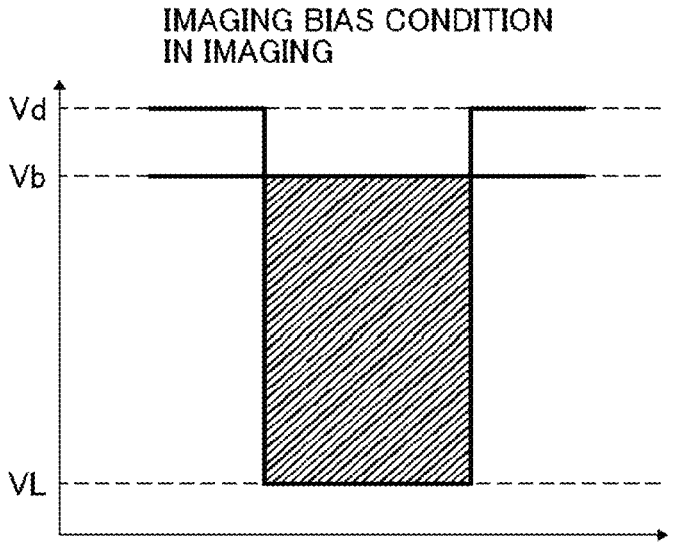
FIGS. 8A and 8B are schematic views showing a bias condition when forming background fouling on purpose.
Figure 8B:
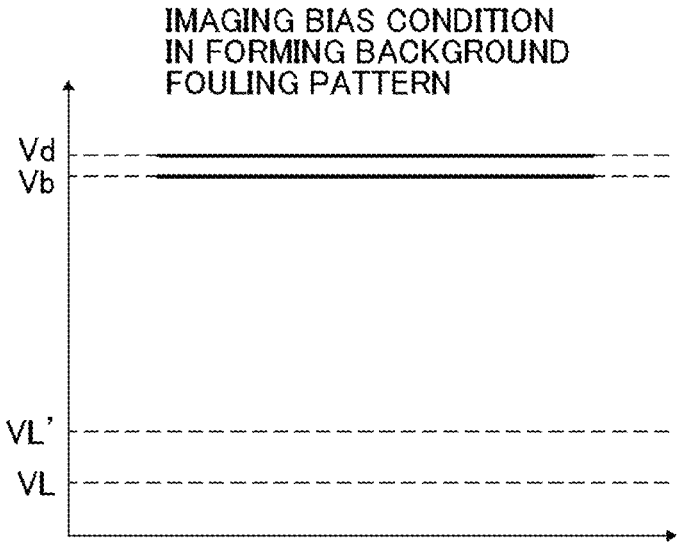

Conventionally, a background fouling pattern intentionally formed as shown in FIG. 8 while image quality is adjusted is detected by a toner detection sensor, and a background potential adjustment mode adjusts charge bias based on the detection result. This mode properly maintain the background fouling.

Figure 9:
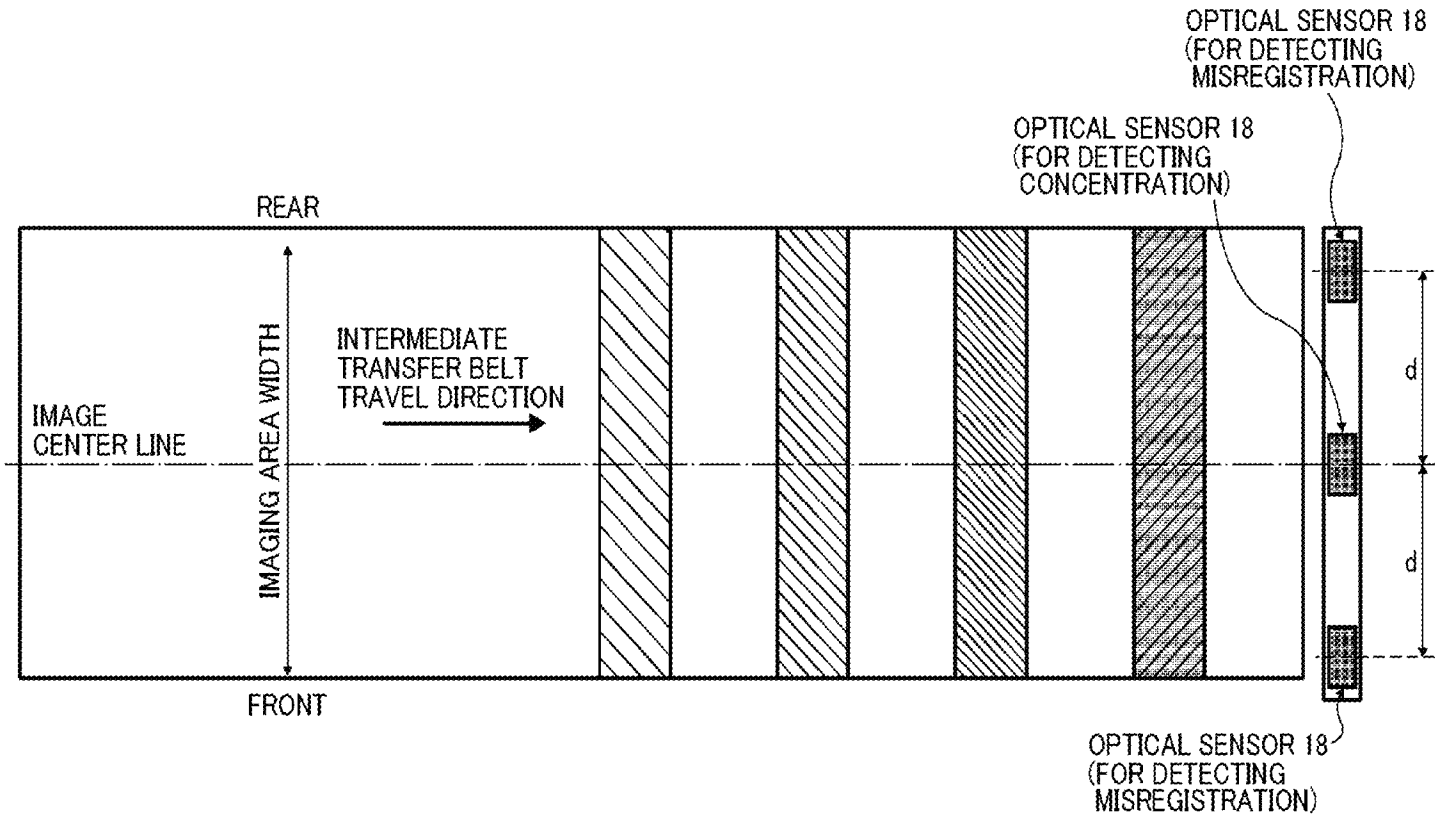
FIG. 9 is a schematic view explaining conventional problems.

However, the background fouling pattern causes a toner to adhere to the whole surface of the photoreceptor drum in the main scanning direction as shown in FIG. 9 because the pattern in formed with bias. Namely, much toner is used out of the area detected by the toner detection sensor. In the present invention, a background fouling pattern is formed only on a part opposite to a toner detection sensor without forming a background fouling pattern on the whole surface of the photoreceptor drum in the main scanning direction. This properly maintains a background potential while restricting consumption of a toner in forming a background fouling pattern, and produces images having proper image density without background fouling and blurred edge.

Hereinafter, an embodiment of the present invention is explained.

Figure 10:
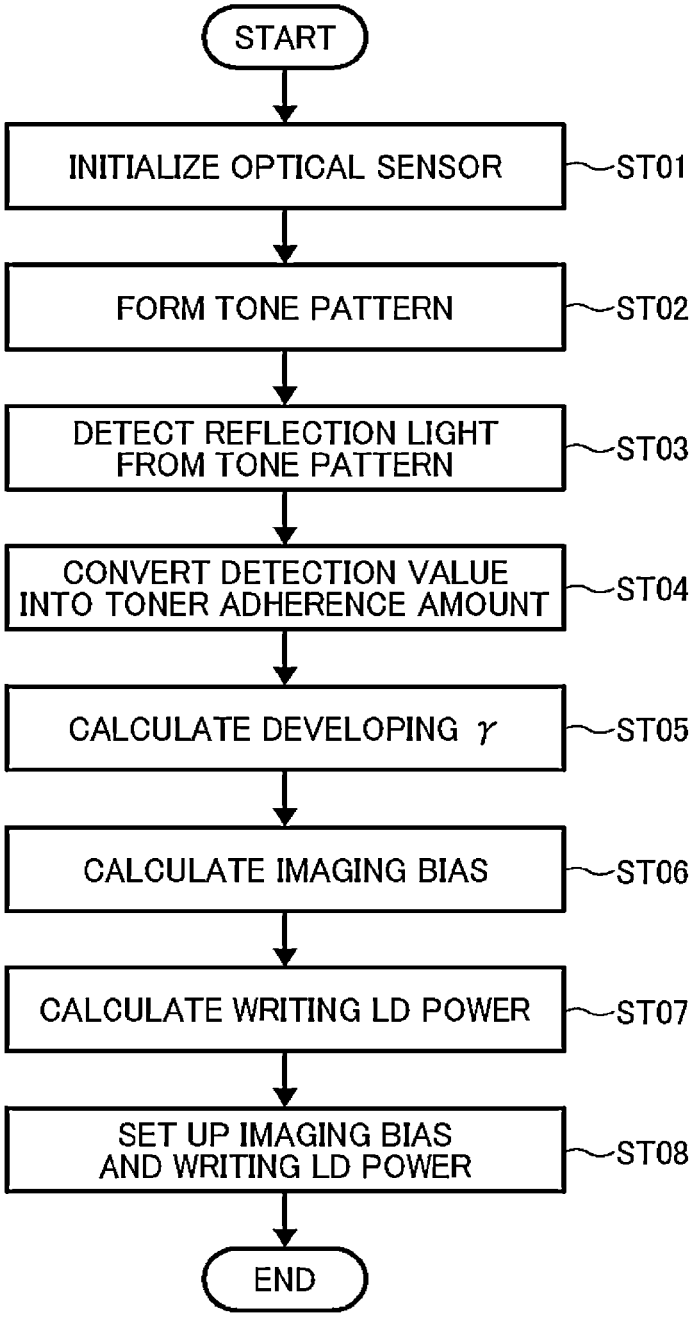
FIG. 10 is a flowchart explaining a charging bias correction operation in an embodiment of the present invention.

In this embodiment, a background pattern is formed and detected after an ordinary image quality adjustment operation (tone pattern formation and detection calculate developing γ to determine imaging conditions such as charging bias, developing bias and writing LD power). Based on the detection result, the charging bias is corrected to keep proper background potential. Operations in this embodiment are explained, referring to FIG. 10.

Figure 11:
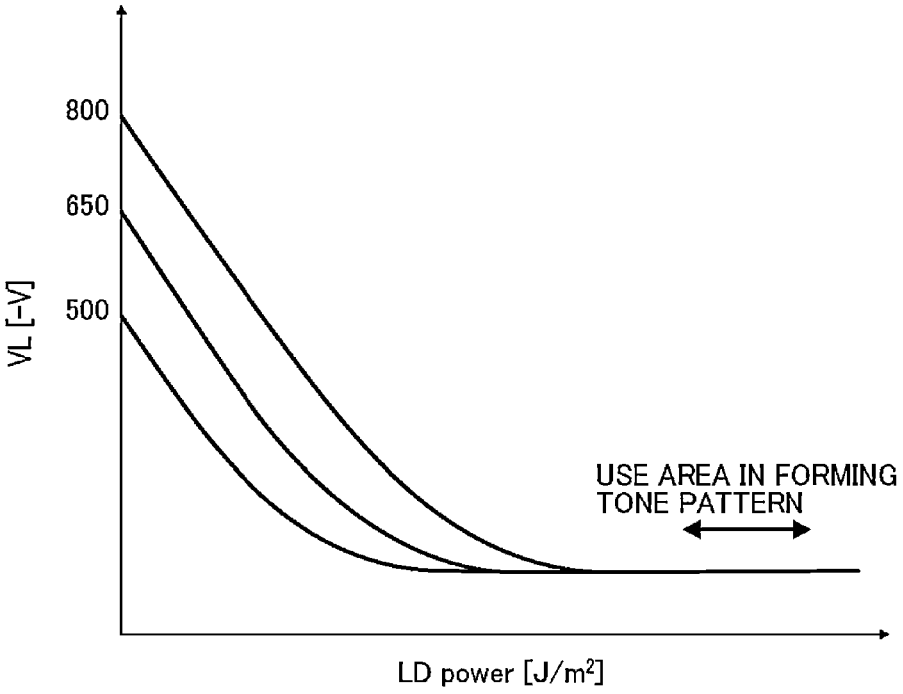
FIG. 11 is a light attenuation curve explaining a relation between an LD power and an irradiated part potential.

First, an optical sensor is corrected (ST01). An LED current is adjusted such that a regular reflection light from the background of the intermediate transfer belt is received by a photodetector at 4.0±0.5 V. Next, an image density adjustment pattern (tone pattern) is formed (ST02). The image density adjustment pattern is shown in FIG. 4. The developing bias and the charging bias are changed while the irradiated part potential is fixed to sequentially form an image from lower developing potential. The writing LD power preferably uses an area capable of fixing an irradiated part potential independently of the charging bias, based on a light attenuation curve as shown in FIG. 11.

Next, reflection light from the toner pattern is detected (ST03). LED light is irradiated to a standard toner pattern, and the reflection light is detected by a phototransistor. In this embodiment, only a regular reflection light is detected from a black pattern and both of a regular reflection light and an irregular reflection light are detected from a color pattern. This is because both of the reflection light are used in a color toner adherence amount conversion algorism mentioned later.

Next, the sensor detection value is converted to a toner adherence amount (ST04). The reflection light from the standard pattern formed in ST03 is detected by an optical sensor 18 as an optical detector located near the outer circumference of the photoreceptor drum 2 as shown in FIG. 1. As shown in FIG. 4, the optical sensor for detecting image density is located at the center of an image, and which detects image density adjustment patterns for all 4 colors. Then, the output value from the optical sensor 18 is converted into a toner adherence amount. A method of converting the toner adherence amount is disclosed in Japanese published unexamined application No. JP-2006-139180-A.

Next, the developing capacity is calculated (ST05). The adherence amount data calculated in ST04 is plotted to the developing potential when the image density adjustment pattern is formed in FIG. 12. These points are linearly approximated by least-squares method to obtain a relational expression representing developing capacity of the image forming apparatus. The inclination of the approximate straight line is developing γ and x-intercept is a development starting voltage Vk. In this embodiment, a linear approximation is used, and quadratic approximation may be used. The developing γ when the quadratic approximation is used is a derivative of the relational expression at a point where the target adherence amount is obtained.

Figure 12:
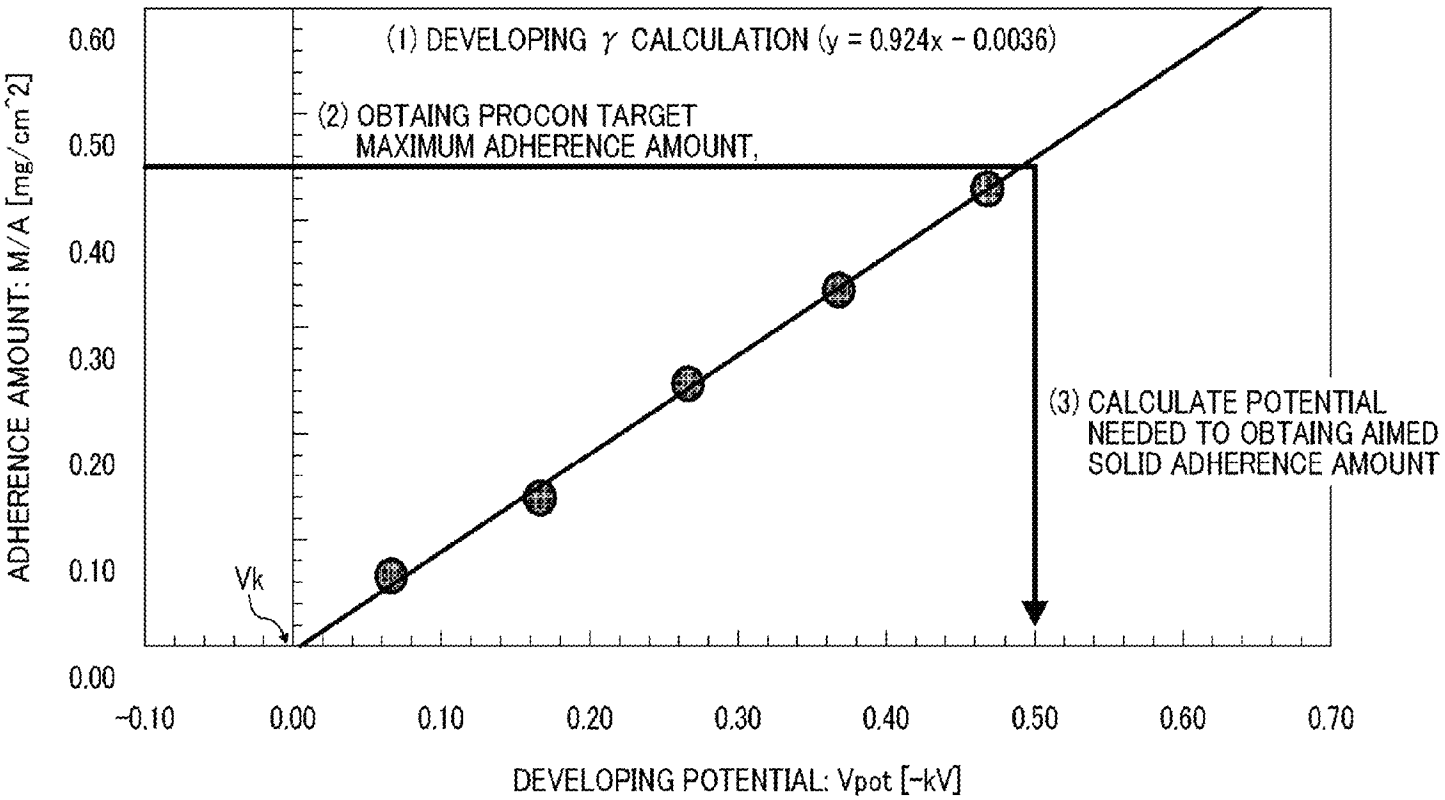
FIG. 12 is a schematic view explaining calculation of developing potential in an embodiment of the present invention.

Next, an imaging bias is calculated (ST06). The developing potential [−V] is calculated from the relational expression obtained in ST05 as shown in FIG. 12. The relational expression of the developing γ (approximation obtained in ST05) and the maximum adherence amount target value are obtained to calculate a developing potential capable of obtaining a target adherence amount.

Next, a method of converting the developing potential into the developing bias. In this embodiment, the irradiated part potential is calculated using the following formulae as a fixed value. A variation of the writing LD power calculated in ST07 is a fixed value 30 [−V].

In a system including a photoreceptor surface potential meter, the irradiated part potential is preferably measured each time.

$$\text{Developing bias } [-V] = \text{Developing potential} + 50\ [-V] \quad (1)$$

wherein the irradiated part potential is 50 [−V].

$$\text{Charging bias } [-V] = \text{Developing bias } [-V] + 200\ [-V] \quad (2)$$

wherein the background potential is 200 [−V].

The background potential is a potential difference set by offsetting the developing bias to prevent background fouling.

Figure 13:
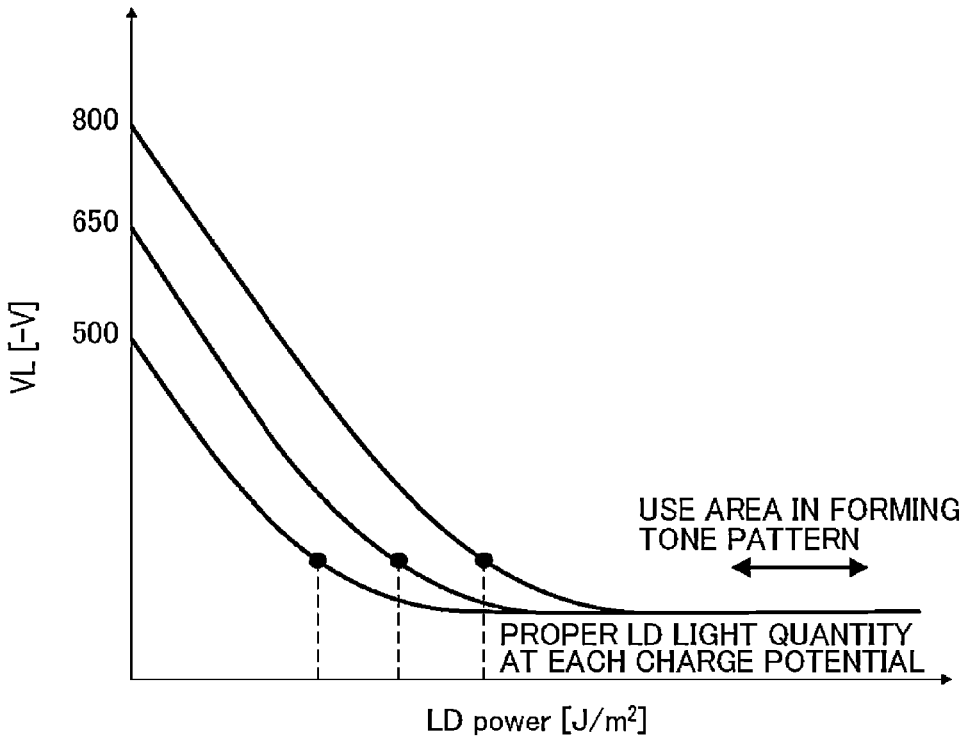
FIG. 13 is a light attenuation curve explaining a relation between an LD power and an irradiated part potential.
Figure 14:
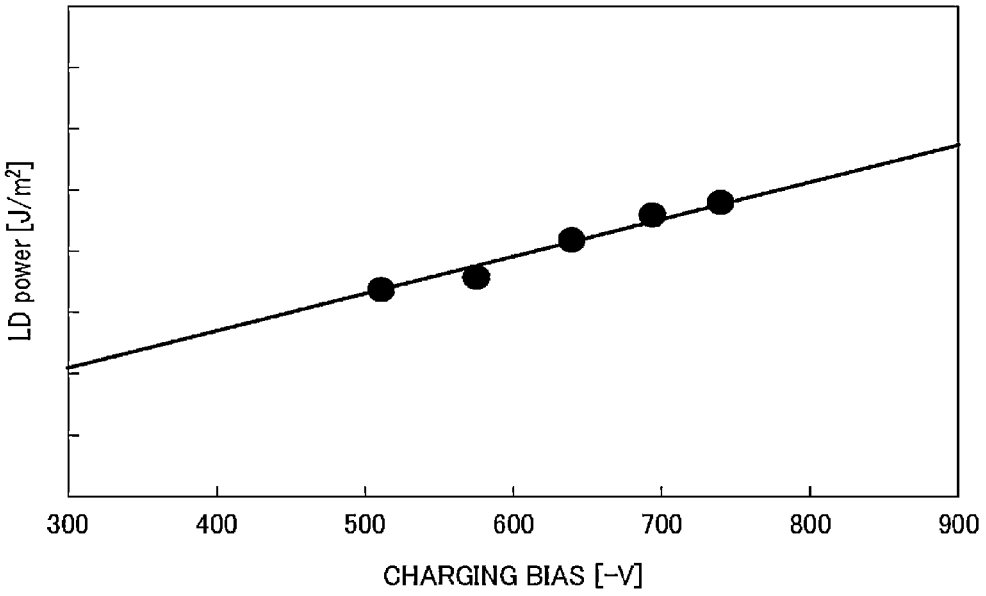
FIG. 14 is an approximate straight line explaining a relation between a charging bias and an LD power.

Next, the writing LD power is calculated (ST07). The writing LD power is calculated, based on the variation of the charging bias. When a part where the derivative of the light attenuation curve in FIG. 11 is close to 0 is used, the writing LD power has a problem such as unstable image density against edge effect and a small electrostatic variation of the photoreceptor surface potential when a part where the derivative is large is sued. Therefore, the writing LD power is preferably set such that the derivative of the light attenuation curve is a predetermined value as shown in FIG. 13, which is neither large nor 0. Experimentally, the light attenuation curve as shown in FIG. 13 is determined from each charging potential. Based on the result, a relation between the charging bias Vc and the writing LD power is determined as shown in FIG. 14. The writing LD power can be calculated by the following linear function including the charging bias Vc as well.

$$[\text{Writing LD Power}] = \alpha Vc + \beta \quad (3)$$

Procedures for determining coefficients α and β in the formula (3) are explained. Writing is performed changing the writing LD power at some stages while the photoreceptor surface potential has a predetermined value. The surface potential of the written part of the photoreceptor is measured by a potential sensor experimentally installed. Further, the charging bias is changed at some stages to obtain a light attenuation curve for each charging bias. This enables it to plot a relation between the charging bias and the writing LD power. From the relation, the writing LD power with a light attenuation curve at each charging potential having a predetermined derivative. Then, a proper writing LD power at each charging potential can be plotted. The linear approximation formula of the plot is determined by least-squares method to determine the coefficients α and β. Thus, the writing LD power is calculated using the formula (3).

Finally, an imaging bias is set (ST08). The imaging conditions are set to the developing bias and the charging bias calculated in ST06, and the writing LD power calculated in ST07.

Figure 15:
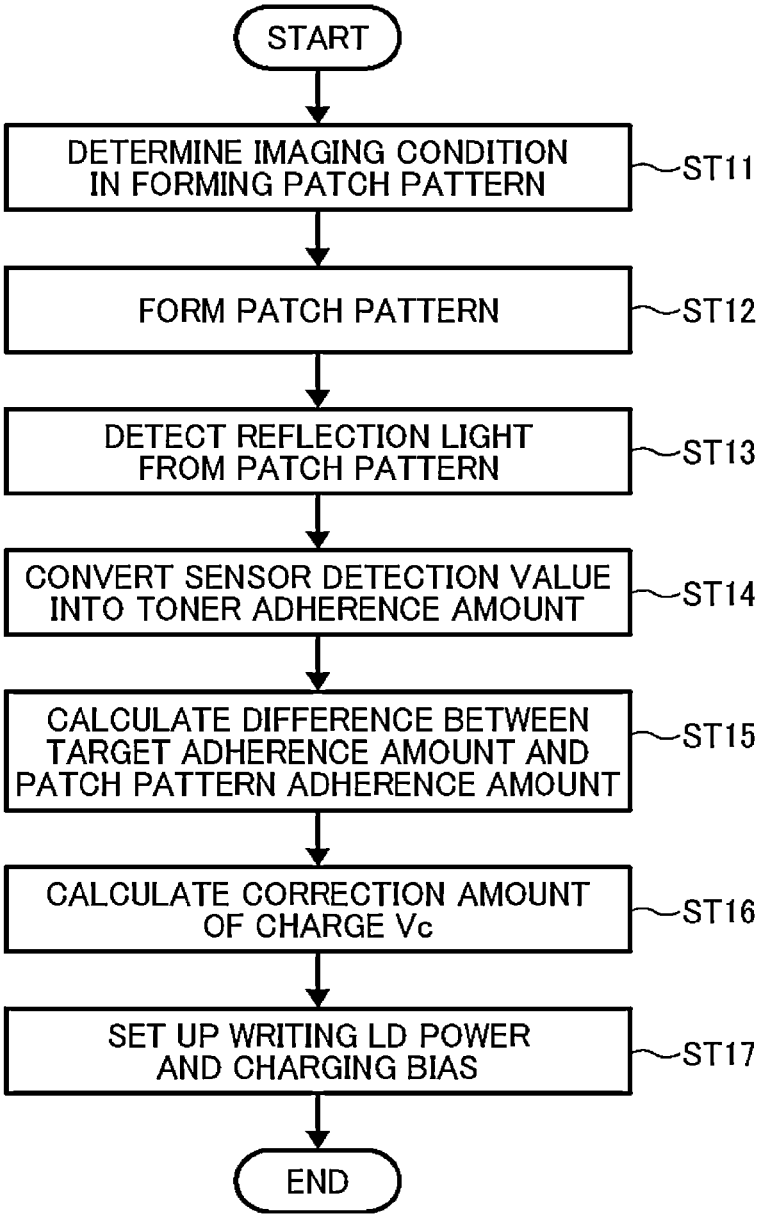
FIG. 15 is a flowchart of image quality control operation in an embodiment of the present invention.

As mentioned above, the developing γ and the developing potential are calculated, and the imaging bias and the writing LD power are determined. However, there is a case where the charging bias is corrected according to the temperature and the number of produced images to properly keep the background potential and prevent background fouling. Even in this case, when the charging potential varies and the charging bias is not set such that the background potential has a proper value, abnormal images having background fouling and blurred edge are produced. In order to solve this problem, In the present invention, a patch pattern is formed after the tone pattern is formed to correct the imaging condition according to the detection result. Hereinafter, the image quality adjustment operation is explained, referring to FIG. 15.

First, imaging conditions of forming a patch pattern are set (ST11). The imaging conditions, i.e., charging bias Vc and developing bias Vb of forming a patch pattern are set to those determined in the above image quality adjustment operation. The writing LD power determined from experiment is used. In this embodiment, the writing LD power making the background potential 50 [−V] is used. The experimental method is mentioned later.

Figure 16:
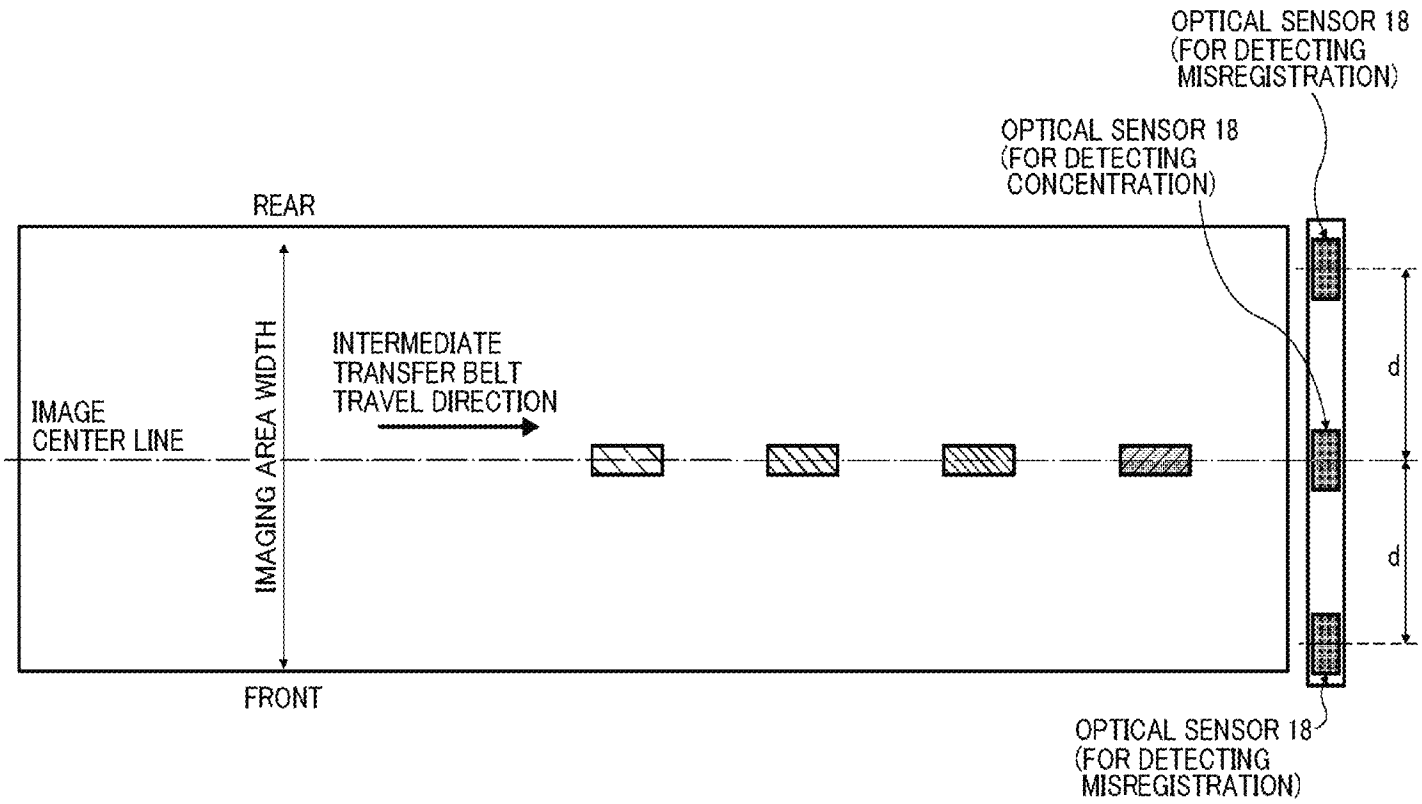
FIG. 16 is a schematic view illustrating a patch pattern used in an embodiment of the present invention.
Figure 17:
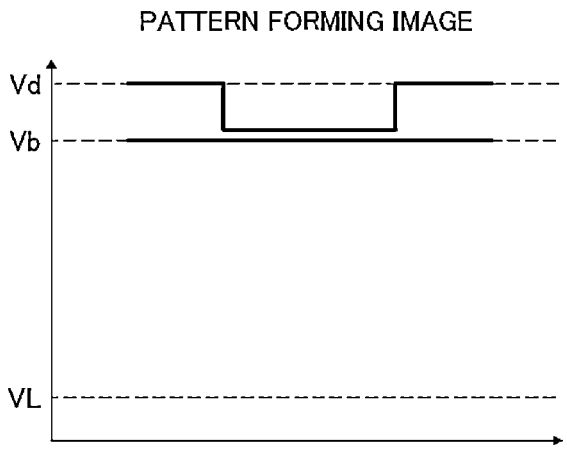
FIG. 17 is a schematic view showing a forming potential of background fouling pattern.

Next, a patch pattern is formed (ST12). FIG. 16 shows a pattern layout of the patch pattern. This is a background fouling pattern because of using the imaging conditions set in (ST11). FIG. 17 shows an image forming potential of the background fouling pattern.

Next, reflection light from the patch pattern is detected (ST13). LED beam is irradiated to the patch pattern formed in ST12 and the reflection light is detected by a phototransistor. In this embodiment, regular reflection light is detected from a black pattern, and regular reflection light and irregular reflection light are detected from a color pattern.

Next, the sensor detection value is converted into a toner adherence amount (ST14). The conversion is made similarly to ST04. The sensitivity correction coefficients α and β calculated in the calculation flow of the developing γ and the developing potential.

Next, a difference between a standard background fouling adherence amount and the patch pattern adherence amount is calculated (ST15). A difference ΔM/A between a toner adherence amount of the patch pattern and a standard background toner adherence amount is calculated. The standard background toner adherence amount is a background fouling adherence amount when the background potential is 50 [−V]. When there is a difference between the patch pattern adherence amount and the standard background toner adherence amount, the charging potential is corrected such that the background potential has a proper value.

Next, a correction amount of the charging potential Vc is calculated from the above difference and the developing γ (ST16). From the developing γ, the developing γ calculated in the developing potential calculation flow, and ΔM/A calculated in ST15, a charging potential correction amount ΔVc is calculated by the following formula using ΔVc (Table) which is a ΔVc correction amount to experimentally determined ΔM/A.

$$\Delta Vc = \Delta Vc\ (\text{Table}) \times \text{developing}\ \gamma\ (\text{def})/\text{developing}\ \gamma \quad (4)$$

wherein ΔVc (Table) is a ΔVc correction amount previously determined from experiment; and developing γ (def) is a standard γ in the imaging system of an object product.

The developing γ is used because ΔVc is small when the developing γ is high and ΔVc is large when the developing γ is low. Vc is calculated using the following formula.

$$Vc' = Vc + \Delta Vc \quad (5)$$

Finally, the imaging conditions are changed to the writing LD power calculated in ST07 and the charging bias calculated in ST16 (ST17).

Figure 18:
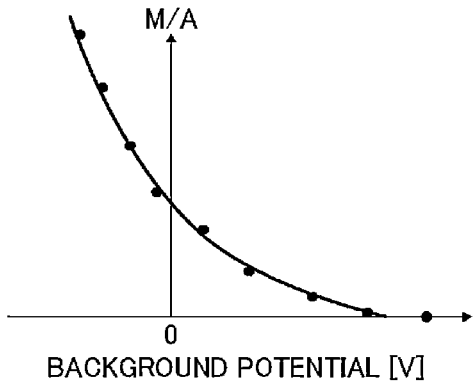
FIG. 18 is a diagram showing a relation between a background potential and a toner adherence amount.
Figure 19:
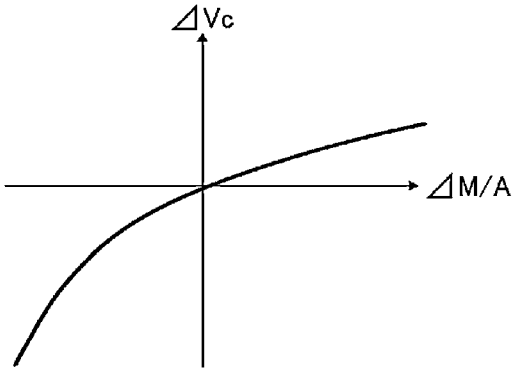
FIG. 19 is a diagram showing a relation between a charging potential correction amount and a difference.

Next, the preparation procedure of the ΔVc (Table) which is a Vc correction amount in thus embodiment is explained. In the standard developing γ, from the imaging bias (charging bias and developing bias) when a target adherence amount is obtainable, the charging bias is switched for some stages to change the background potential and intentionally raise background fouling. As a result, a relation between the background potential and a toner adherence amount due to background fouling as shown in FIG. 18 is experimentally obtained. From the result, an adherence amount when the background potential is 50 [−V] is calculated to be a standard background adherence amount. From a difference as shown in FIG. 19 between the standard background adherence amount and the adherence amount of the background fouling patch pattern formed and detected from the flowchart explained in FIG. 15, how much the background potential is corrected is calculated.

Figure 20A:
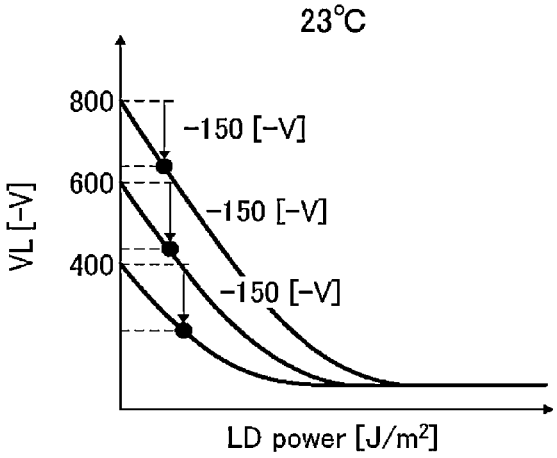
FIGS. 20A, 20B and 20C are light attenuation curves explaining a relation between an LD power and an irradiated part potential in each environment.
Figure 20B:
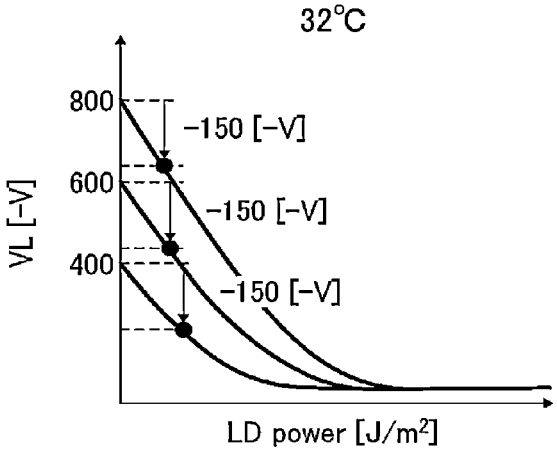
Figure 20C:
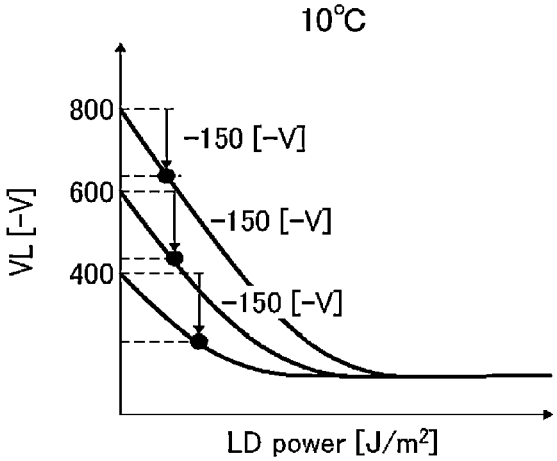
Figure 21A:
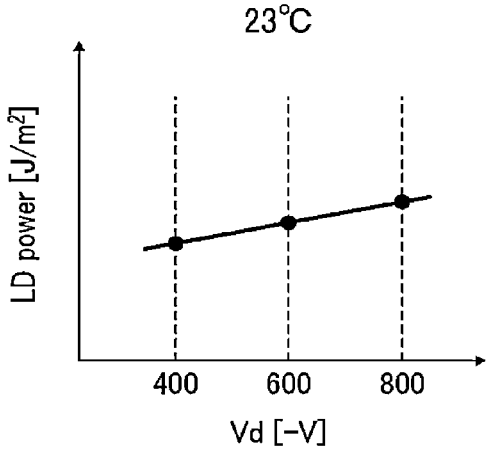
FIGS. 21A, 21B and 21C are diagrams showing a relation between a charging potential and an LD power in each environment.
Figure 21B:
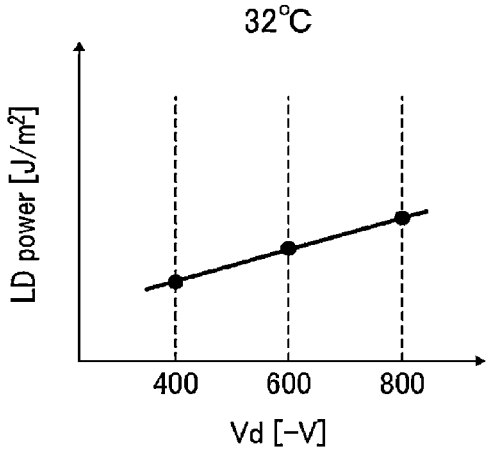
Figure 21C:
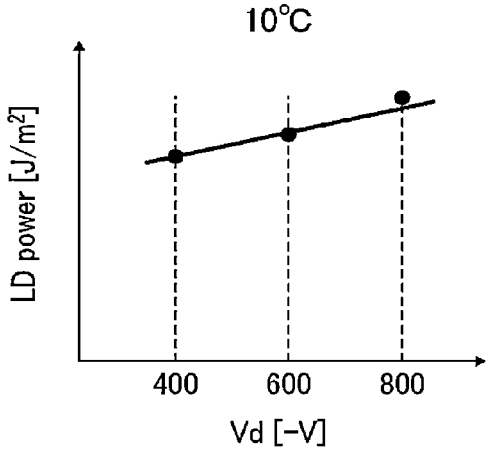
Figure 22A:
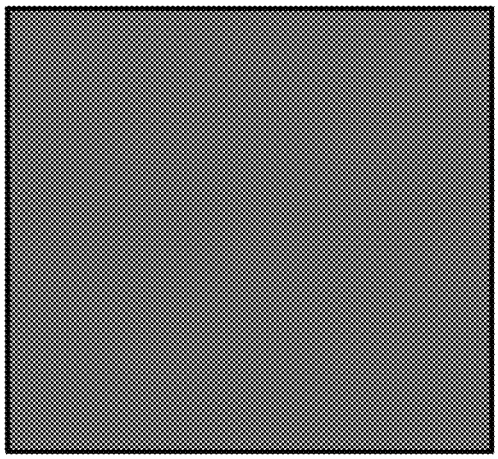
FIGS. 22A and 22B are schematic views for explaining a light quantity of pattern.
Figure 22B:
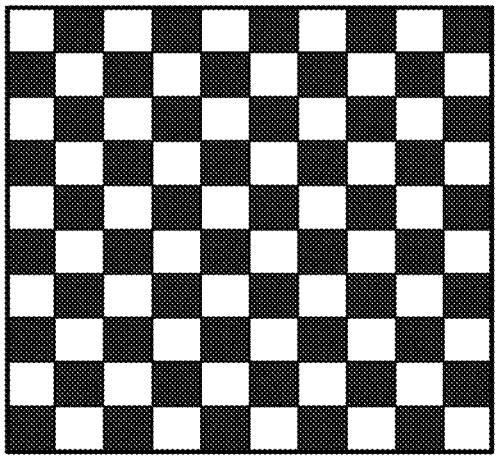

Next, a procedure for setting the writing LD power in this embodiment is explained. The writing LD power is set from Vd and a table of temperature, and a method of making the table is explained as follows. First, as FIGS. 20A, 20B and 20C show, a writing LD power is irradiated at each environment (10° C., 23° C. and 32° C.) and each Vc (charging potential of 3 levels 400, 600 and 800 [−V]) while changing the levels. The irradiated part potential is measured by a potential sensor to obtain a light attenuation curve of each environment. A proper background potential 200 [−V] is attenuated by a charging potential Vd 150 [−V], and a writing LD power for making the background potential 50 [−V] is calculated. The results are plotted in a coordinates shown in FIGS. 21A, 21B and 21C in which x-axis is Vd and y-axis is LD power, and the plotted points are linearly approximated. An initial background potential 200 [−V] is attenuated by a charging potential Vd 150 [−V], and a writing LD power for making the background potential 50 [−V] is calculated. The LD power is used when a pattern is formed. The light quantity of the pattern is changed by LD-Duty as FIG. 22A shows, and may be dot matrix as FIG. 22B shows.

Figure 23:
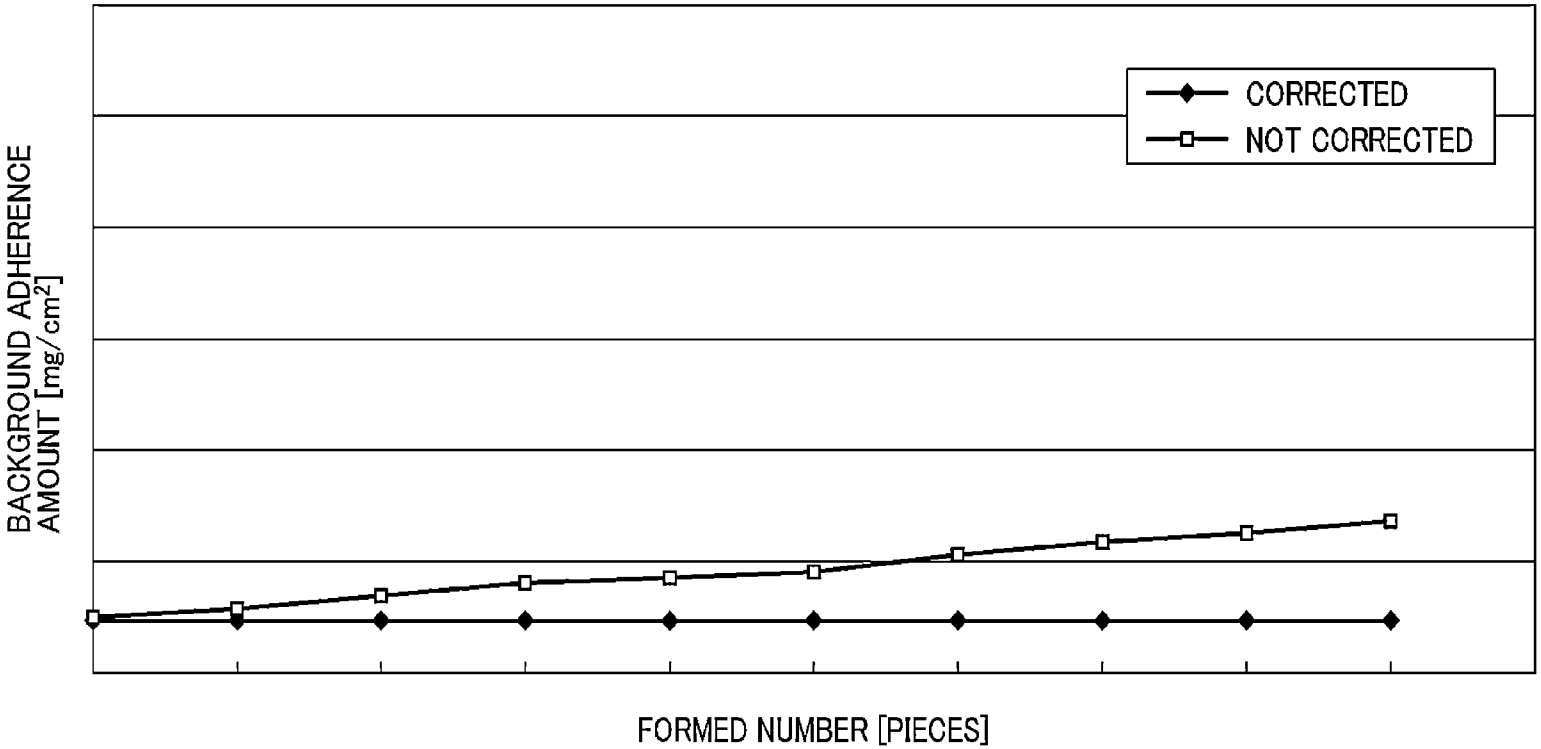
FIG. 23 is a diagram showing an effect of the present invention for background fouling.
Figure 24:
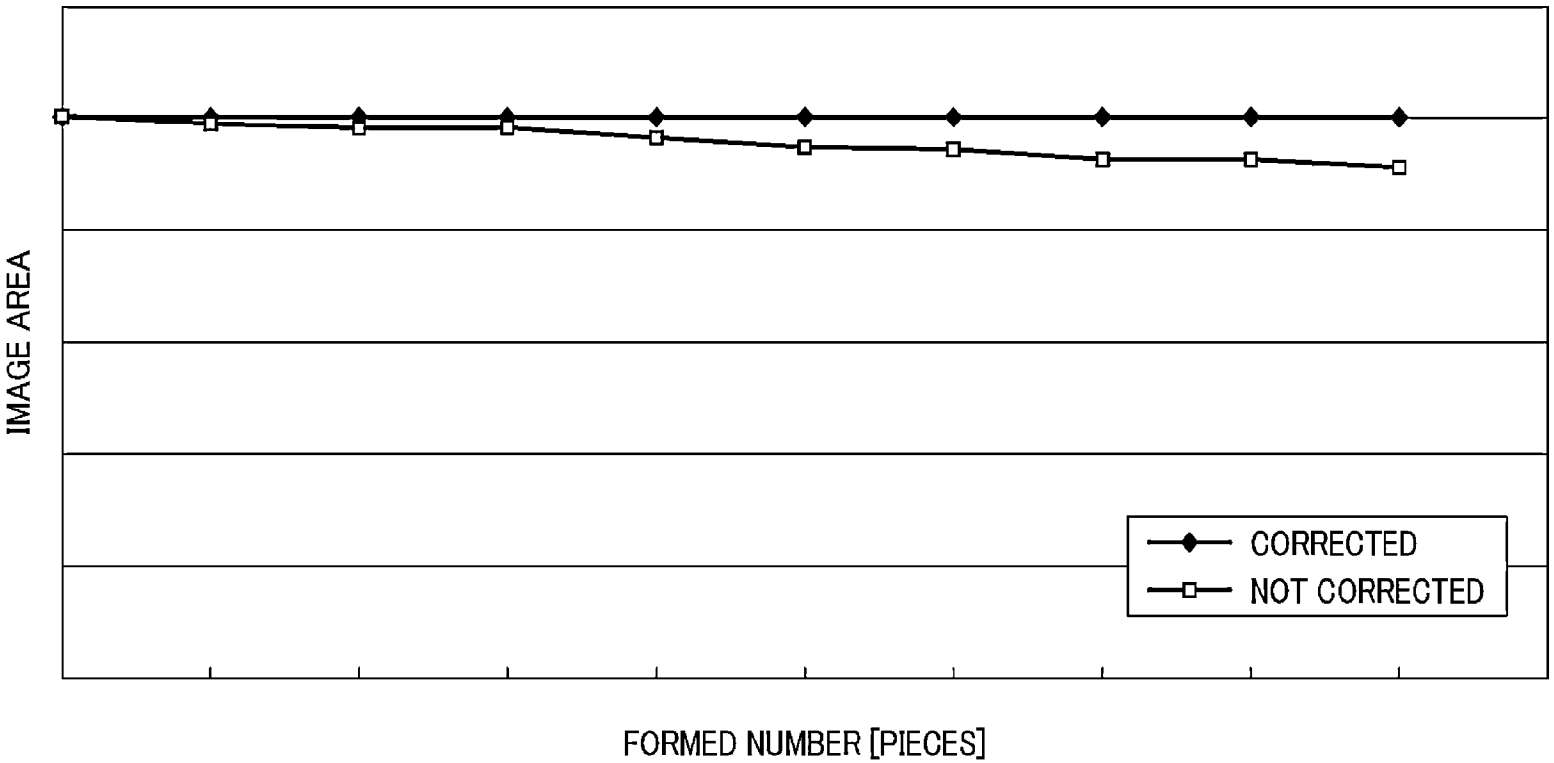
FIG. 24 is a diagram showing an effect of the present invention for blurred edge.

FIG. 23 shows effects on background fouling, and FIG. 24 on blurred edge before and after correction, respectively. In the present invention, background fouling caused by small background potential and blurred edge caused by large background potential are effectively be prevented and quality images are produced because ground potential can properly be maintained.

Next, another embodiment of the present invention is explained. Background fouling pattern formation and detection are independently made. Based on the background fouling pattern, charging potential is corrected. Imaging bias is fixed when not corrected to adjust image quality, only LD power is corrected, based on environment table.

In each of the above embodiments, execution determination is made in a minimum timing to suppress consumption of toner. Since the surface potential of a photoreceptor varies according to environment, from information of the temperature sensor 204 detecting environmental temperature of an image forming apparatus, the execution determination may be made when the temperature varies over a predetermined threshold since the previous time of controlling background potential. In addition, the surface potential of a photoreceptor varies due to variation of its film thickness as time passes. The execution determination may be made when the number of prints produced by an image forming apparatus is a predetermined quantity. These execution determinations prevents production of abnormal images such as background fouling and blurred edge while suppressing consumption of toner.

A tone pattern is formed, image quality adjustment of determining developing γ from the toner pattern is performed, and a patch pattern is irradiated on a photoreceptor such that background potential is narrowed to form a toner image having background fouling. Toner adherence amount of the background fouling is detected by a sensor. Based on the detection result, charging potential is corrected to properly keep background potential, and prevent background potential and blurred edge.

Since irradiation quantity is corrected according to temperature detection result by a temperature detection sensor 204, a writing LD power for background patch pattern is determined from temperature to constantly maintain a difference between charging potential and patch pattern potential.

Thereby, toner adherence amount of patch pattern relative to variation of the background potential is precisely measured.

Since irradiation quantity is corrected according to charging conditions when a toner patch image is formed, a writing LD power for background patch pattern is determined from temperature to constantly maintain a difference between charging potential and background fouling patch pattern potential. Thereby, toner adherence amount of background fouling patch pattern relative to variation of the background potential is precisely measured.

Based on the temperature detection result, correction of charging conditions is subject to execution determination with toner patch image prevents abnormal images such as background fouling and blurred edge while suppressing consumption of toner more than when constantly controlled. Further, based on the number counter information, correction of charging conditions is subject to execution determination with toner patch image prevents abnormal images such as background fouling and blurred edge while suppressing consumption of toner more than when constantly controlled.

The above embodiment is a full-color copier as image forming apparatus. The image forming apparatus of the present invention is not limited thereto, and may be a printer, a monochrome copier, a facsimile, a plotter or their complex machine. The present invention further includes other image forming apparatuses such as full-color copiers using four-tandem direct transfer methods and one-drum intermediate transfer methods, and monochrome copiers using one-drum direct transfer methods.

Having now fully described the invention, it will be apparent to one of ordinary skill in the art that many changes and modifications can be made thereto without departing from the spirit and scope of the invention as set forth therein.

What is claimed is:

1. An image forming apparatus, comprising:

an image bearer;

a charger configured to charge the image bearer;

an electrostatic latent image former configured to form an electrostatic latent image on the image bearer;

an image developer configured to develop the electrostatic latent image with a toner to form a visual toner image;

a transferer configured to transfer the toner image on a transfer material;

a toner concentration calculator configured to calculate a concentration of the toner; and an optical detector, wherein at least a toner patch image is formed on the image bearer with an irradiation quantity set such that an irradiated part potential is larger than a developing condition, the toner patch image is read by the optical detector, and a charging condition is corrected on the basis of a difference between a toner concentration of the toner patch image and a target toner concentration.

2. The image forming apparatus of claim 1, further comprising a temperature detector, wherein the irradiation quantity is corrected on the basis of a temperature detection result by the temperature detector.

3. The image forming apparatus of claim 1, wherein the irradiation quantity is corrected on the basis of the charging condition when forming the toner patch image.

4. The image forming apparatus of claim 1, wherein an execution determination of the charging condition correction using the toner patch image is made on the basis of a temperature detection result by a temperature detector.

5. The image forming apparatus of claim 1, further comprising a counter configured to count a number of prints, wherein an execution determination of the charging condition correction using the toner patch image is made on the basis of information of the counter.

6. An image forming apparatus forming an image by a method comprising:

changing a charging potential and developing potential in stages for each color toner;

imaging plural toner tone patterns at a constant irradiation quantity;

reading the toner tone pattern with an optical detector to calculate a developing capacity;

determining a charging condition and a developing condition, based on the developing capacity to obtain a target toner concentration; and determining an irradiating condition, based on the charging condition, wherein the image forming apparatus comprises a toner concentration calculator configured to calculate the toner concentration, and the method further comprises:

forming at least one toner patch image with an irradiation quantity set such that an irradiated part potential on the charging condition and the developing condition is at least larger than the developing condition; and reading the toner patch image with the optical detector to correct the charging condition, based on a difference between a toner concentration of the toner patch image and the target toner concentration.

7. The image forming apparatus of claim 6, further comprising a temperature detector, wherein the irradiation quantity is corrected on the basis of a temperature detection result by the temperature detector.

8. The image forming apparatus of claim 6, wherein the irradiation quantity is corrected on the basis of the charging condition when forming the toner patch image.

9. The image forming apparatus of claim 6, wherein an execution determination of the charging condition correction using the toner patch image is made on the basis of a temperature detection result by a temperature detector.

10. The image forming apparatus of claim 6, further comprising a counter configured to count a number of prints, wherein an execution determination of the charging condition correction using the toner patch image is made on the basis of information of the counter.

* * * * *